US011821123B2

(12) United States Patent
Reuben

(10) Patent No.: US 11,821,123 B2
(45) Date of Patent: Nov. 21, 2023

(54) FABRIC SHEET LOADING AND UNLOADING MACHINE FOR A COMPUTER CONTROLLED PATTERN FORMING MACHINE

(71) Applicant: Ronie Reuben, Mont-Royal (CA)

(72) Inventor: Ronie Reuben, Mont-Royal (CA)

( * ) Notice: Subject to any disclaimer, the term of this patent is extended or adjusted under 35 U.S.C. 154(b) by 504 days.

(21) Appl. No.: 16/960,245

(22) PCT Filed: Jan. 5, 2018

(86) PCT No.: PCT/IB2018/050090

§ 371 (c)(1),
(2) Date: Jul. 6, 2020

(87) PCT Pub. No.: WO2019/135106

PCT Pub. Date: Jul. 11, 2019

(65) Prior Publication Data

US 2020/0362494 A1 Nov. 19, 2020

(51) Int. Cl.
*D05C 9/06* (2006.01)
*D05B 37/10* (2006.01)
(Continued)

(52) U.S. Cl.
CPC ..... *D05C 9/06* (2013.01); *D05B 37/10* (2013.01); *D05C 7/08* (2013.01); *D06H 7/02* (2013.01);
(Continued)

(58) Field of Classification Search
CPC ..... D05C 9/04; D05C 9/06; D05D 2305/10; D05D 2305/12; D05D 2207/04;
(Continued)

(56) References Cited

U.S. PATENT DOCUMENTS 4,422,310 A 12/1983 Eggenberger
4,672,172 A 6/1987 Pearl
(Continued)

FOREIGN PATENT DOCUMENTS

CN 106436082 A 2/2017

OTHER PUBLICATIONS

Supplementary European Search Report with regard to PCT/IB2018/050090 dated Dec. 8, 2021.
(Continued)

*Primary Examiner* — Nathan E Durham

(57) ABSTRACT

A composite fabric sheet loading and unloading machine and its method of operation is described for loading and unloading a composite fabric sheet into a computer controlled stitching and laser cutting machine. The composite fabric sheet is restrained on a rectangular contour support frame of a transport platform which is displaceably and guidingly transported into the stitching and laser cutting machine where programmed pattern fabric pieces are formed in the restrained fabric sheet. The transport platform is then unloaded and transferred back to its original position where the pattern pieces and trimmings are separated and a new composite sheet is positioned and restrained on the flat top surface to repeat the operation. A transport platform is provided on opposed sides of the computer controlled stitching and die cutting machine wherein after the unloading of the transport platform another transport platform is loaded into the stitching and laser cutting machine from the opposed side.

18 Claims, 4 Drawing Sheets

(51) Int. Cl.
*D05C 7/08* (2006.01)
*D06H 7/02* (2006.01)

(52) U.S. Cl.
CPC ..... *D05D 2207/04* (2013.01); *D05D 2303/20* (2013.01); *D05D 2305/12* (2013.01)

(58) Field of Classification Search
CPC ..... D05B 37/10; D05B 33/02; D05B 39/00; D06H 7/02; A41H 42/00
See application file for complete search history.

(56) References Cited

U.S. PATENT DOCUMENTS

| | | | | |
|---|---|---|---|---|
| 5,325,802 | A * | 7/1994 | Stutznacker ..... | D05B 11/00 198/470.1 |
| 5,363,785 | A * | 11/1994 | Conley, Jr. ..... | D05B 39/00 198/345.3 |
| 10,208,415 | B2 | 2/2019 | Reuben | |
| 2014/0251193 | A1* | 9/2014 | Resta ..... | D05B 39/00 112/475.08 |

OTHER PUBLICATIONS

Supplementary European Search Report with regard to European Patent Application No. 18898168.2 dated Dec. 8, 2021.
International Search Report and Written Opinion with regard to PCT/IB2018/050090 dated Sep. 21, 2018.

* cited by examiner

FABRIC SHEET LOADING AND UNLOADING MACHINE FOR A COMPUTER CONTROLLED PATTERN FORMING MACHINE

TECHNICAL FIELD

The present invention relates to a loading and unloading machine and its method of operation for positioning a composite fabric sheet in a computer controlled stitching and laser die cutting machine where pattern fabric pieces are formed.

BACKGROUND OF THE INVENTION

Reference is made to my earlier filed co-pending U.S. patent application Ser. No. 14/998,509 filed on Jan. 15, 2016, which is incorporated herein by reference and in which there is described a continuous process to automatically fabricate patterned composite fabric pieces with seam allowance flaps for interconnecting the fabric pieces in precise locations to form fabric articles. The process is a continuous line process employing conveyor belts on which a composite fabric sheet is fed from a supply roll. That patent application also describes the many advantages of the process, such as decreasing labour content used for the fabrication of fabric articles, reducing the loss of fabric material, using less skilled labour, reducing pollution in the air produced by floating fabric fibers during manufacture and hence the danger to the health of the workers.

There is a need to provide an improved process and machine which utilizes very little manpower and at the same time assuring the quality control of the process and the pattern pieces produced with minimal material loss and imperfections and wherein the process is a substantially continuous process employing only one or two operator person.

SUMMARY OF THE INVENTION

It is a feature of the present invention to provide a novel loading and unloading machine in association with a computer controlled stitching and laser cutting machine which provides all of the benefits and needs mentioned above and which operates on a substantially continuous basis with minimal labour content.

It is a further feature of the present invention to provide a novel loading and unloading machine in association with a computer controlled stitching and laser die cutting machine and which is substantially automated for the production of precise fabric pattern pieces of precise shapes and with minimal fabric loss.

Another feature of the present invention is to provide a novel method of positioning a composite fabric sheet having a core material sandwiched between two scrim sheets, or a top sheet of outer wear material and an inner liner sheet material, in a computer controlled stitching and laser cutting machine to form composite fabric material pattern pieces.

According to the above features, from a broad aspect, the present invention provides a composite fabric sheet loading and unloading machine for positioning the composite fabric sheet in a computer controlled stitching and laser cutting machine. The loading and unloading machine comprises a transport platform displaceably mounted on a support frame. The transport platform has a rectangular contour support frame for supporting the composite fabric sheet in a horizontal suspended plane. Restraining means is provided for restraining the fabric sheet taunt over the rectangular contour support frame. Displacement means displaces the transport platform from a composite fabric sheet loading and pattern pieces unloading position to a fabric sheet pattern forming position in the stitching and laser cutting machine and back to the fabric sheet loading and pattern pieces unloading position for discharging formed fabric pattern pieces.

According to a further broad aspect of the present invention there is provided a method of positioning a composite fabric sheet in a computer controlled stitching and laser cutting machine to form a composite pattern fabric pieces. The method consists of positioning a rectangular composite fabric sheet on a rectangular contour support frame of a transport platform at a fabric sheet loading and pattern pieces unloading location. The fabric sheet is retained in a horizontal suspended plane by restraining means. The transport platform is guidingly displaced at a precise location into the stitching and laser cutting machine. Contour patterns are stitched in the suspended composite fabric sheet. The composite fabric sheet with the stitched contour patterns is then displaced on a support surface spaced between the horizontal support plane and the composite fabric sheet is laser cut about the stitched contour patterns to form individual pattern pieces, The platform with the formed fabric pieces is thereafter displaced back to the fabric sheet loading and pattern pieces unloading location. The formed pattern pieces and fabric trimmings are removed from the flat top surface and another composite fabric sheet is secured to the rectangular contour support frame and restrained ready to be transferred again into the computer controlled stitching and laser cutting machine.

DESCRIPTION OF THE DRAWINGS

A preferred embodiment of the present invention will now be described with reference to the accompanying drawings wherein.

DETAILED DESCRIPTION OF THE DRAWINGS

Figure 1:
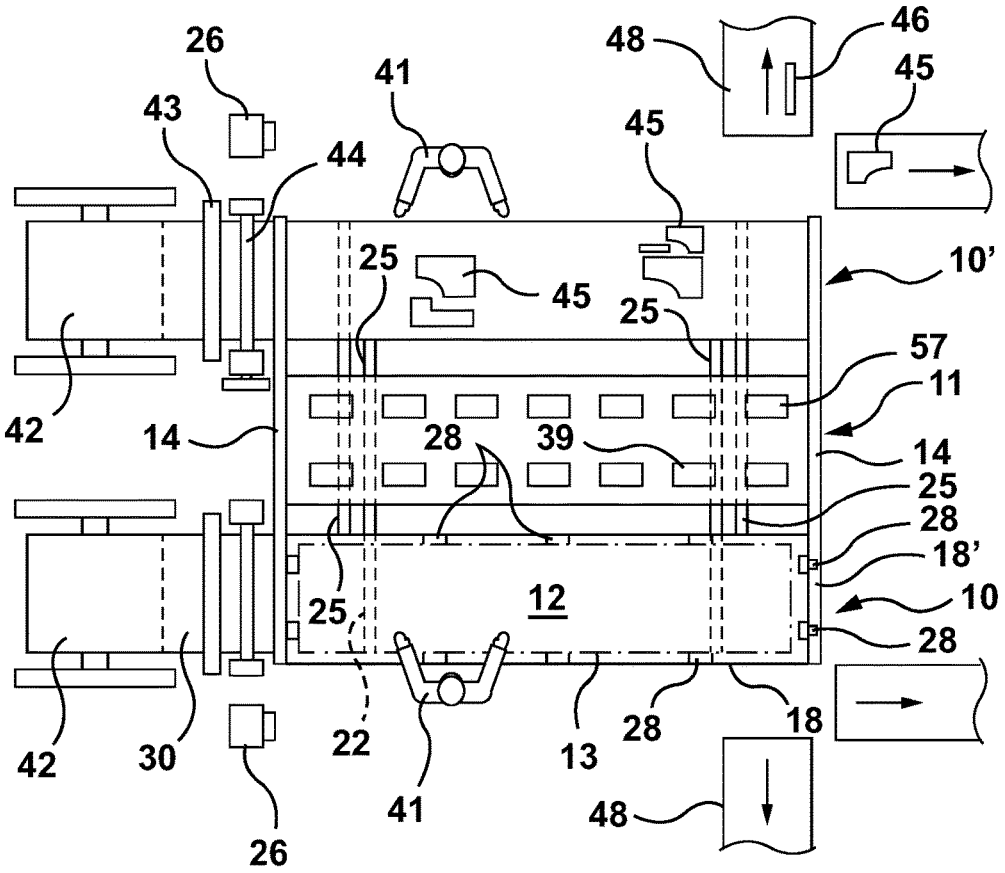
FIG. 1 is a simplified top view illustrating the fabric loading and pattern pieces unloading machine for positioning a composite fabric sheet in a computer controlled stitching and laser cutting machine.
Figure 2:
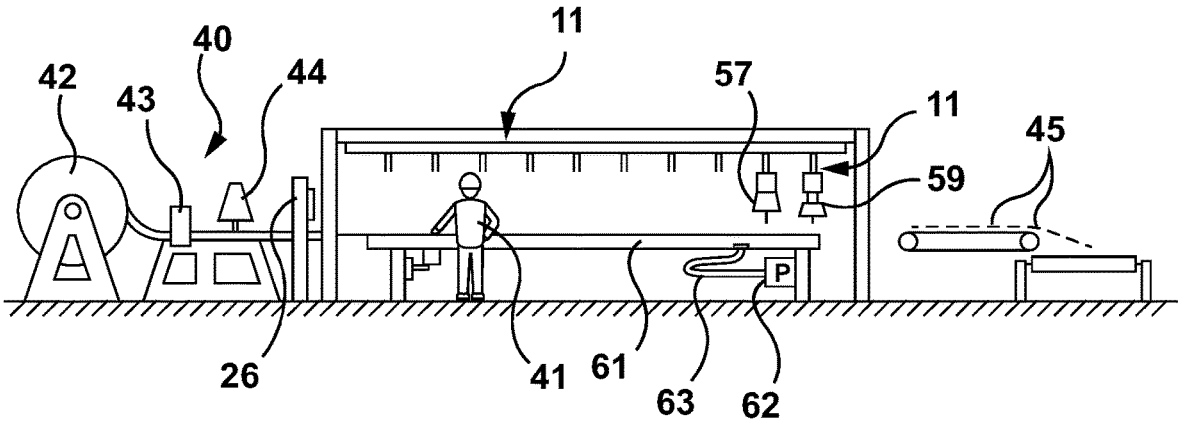
FIG. 2 is a simplified side view illustrating the fabric sheet loading and pattern pieces unloading machine of FIG. 1.

Referring to the drawings and more particularly to FIGS. 1 and 2 there is shown generally at 10 and 10' two fabric sheet loading and unloading machine disposed on a respective side of a computer controlled stitching and laser cutting machine 11 for positioning therein a composite fabric sheet 12 at a precise location. The stitching and laser die cutting machine can be programmed to stitch and cut different shapes of patterns in the composite fabric sheet and form embroidery designs therein. An embroidery machine is known and constructed by Lasser AG, of Switzerland. However, such type machine requires to be adapted to work in conjunction with the fabric sheet loading and unloading machine of the present invention and to form and laser cut seam allowance flaps associated with at least some of the pattern pieces. The fabric sheet loading and unloading machines 10 and 10' are identically constructed and for simplicity of description only one machine 10 is described herein.

Figure 3:
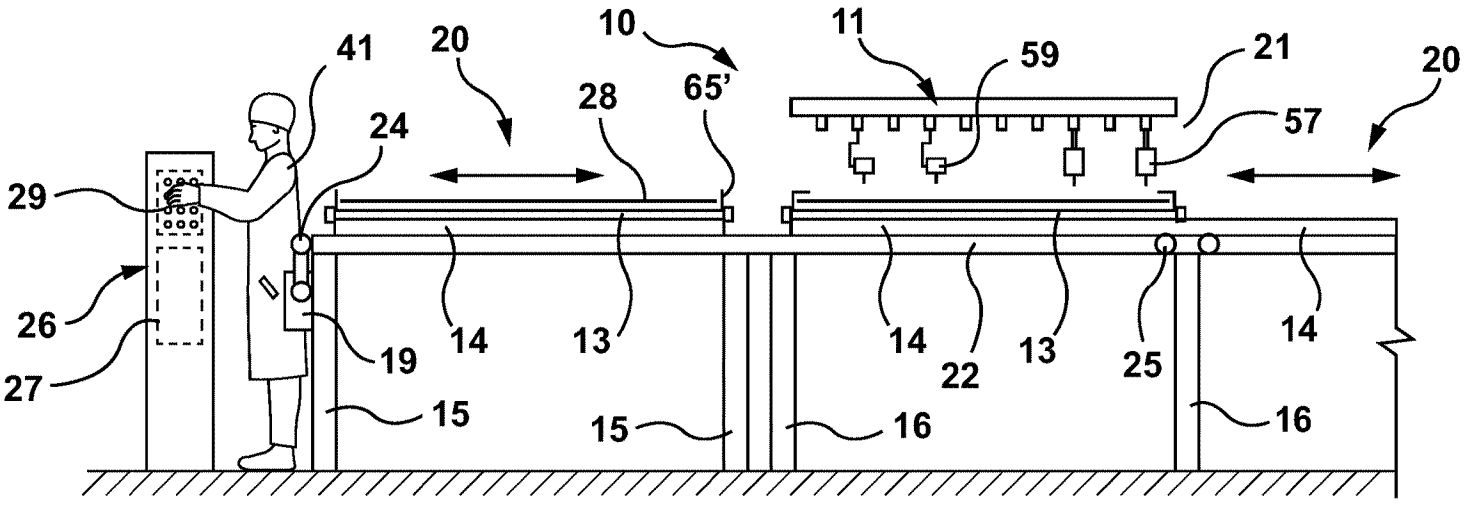
FIG. 3 is an end view of the transport platform in relation to the computer controlled pattern forming machine showing the drive belt displacement system which displaces the transport platform from its loading and pattern pieces unloading position to a stitching and laser cutting machine and guided in a horizontal plane between opposed guide rails.

With additional reference to FIGS. 3 to 6, a detailed description of one embodiment of the fabric sheet loading and unloading machine 10 follows. The machine 10 is comprised of a transport platform 13 which, in one embodiment, is displaceably mounted between a pair of space-apart parallel guide rails 14 connected to a support frame 15 and the frame 16 of the computer controlled stitching and laser die-cutting machine 11. The transport platform 13 has a rectangular contour support structural frame 17 defining opposed parallel side edges 18 and end edges 18'. A motorized drive mechanism 19 is coupled to the transport platform 13 to displace it from its loading and unloading position 20 as shown in FIG. 3, to the fabric pattern piece forming position 21 in the computer controlled stitching and laser cutting machine 11.

Figure 4A:
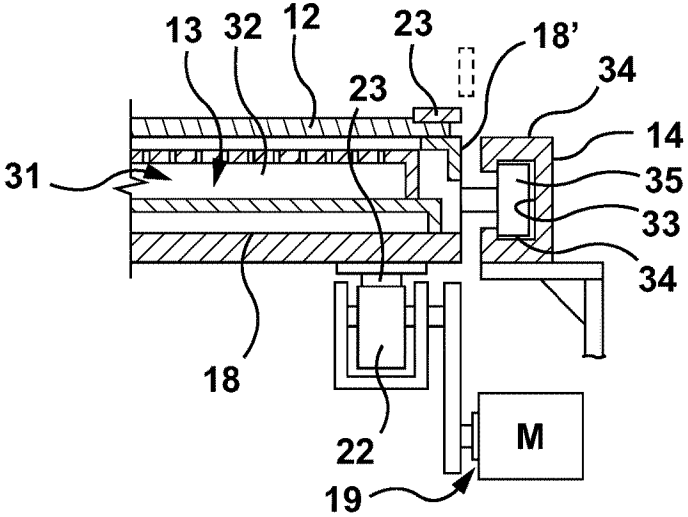
FIG. 4A is a fragmented end view showing the coupling of the transport platform with the guide rails or displacement of the transport platform on conveyor belts.
Figure 4B:
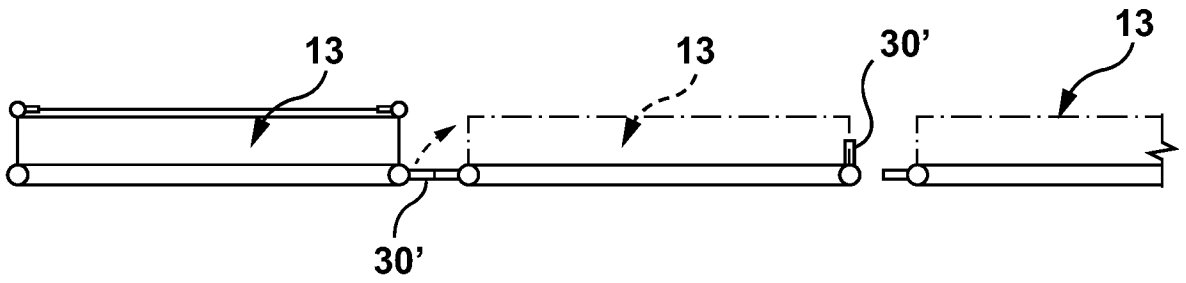
FIG. 4B is a side view showing the transport platform transferred to the computer controlled stitching and laser cutting machine and held captive therein for displacement thereof to effect pattern pieces stitched and laser cut in the composite fabric sheet.

The drive mechanism 19 is comprised by a pair of synchronized drive belts 22, only one being shown in FIG. 4A, supported under the frames 15 and 16 and coupled to the transport platform 13 by a respective connector bracket 23. The drive belts 22 are trained about a drive sprocket 24 and an idle sprocket 25. They are controlled by a station control device 26 interfacing with a main controller 27 in the control device 26 wherein one of the transport platforms of both loading and unloading machines 10 and 10' cannot be displaced into the computer controlled stitching and laser die cutting machine 11 if the transport platform of the other machine is still in the stitching and laser cutting machine 11. It is also conceived that the transport platform 13 may be transferred in the machine 11, and in a guided manner, by drive belts in friction contact with the underside of the platform and held in precise position in the machine 12 by hinge plates 30, as shown in FIG. 4B. Also, the transport platform can be secured to a displaceable frame, not shown, to displace the composite fabric sheet under the stitching heads 59 and laser cutters 57, which remain stationary, whereby to follow the programmed patterns to form the pattern fabric pieces.

Figure 5:
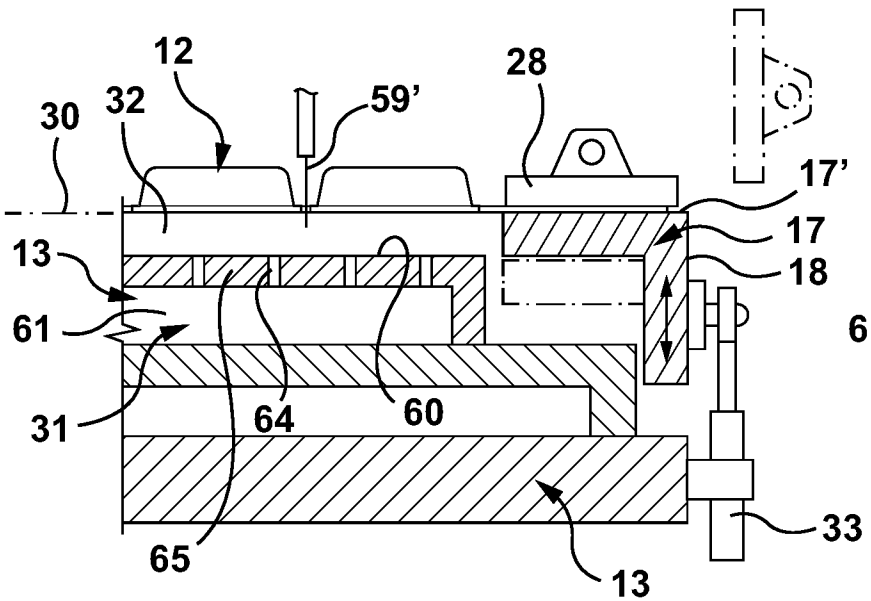
FIG. 5 is a side view illustration showing the composite fabric sheet held suspended in a horizontal plane wherein programmed stitched patterns and embroidery designs can be made in the composite fabric sheet.

As shown in FIGS. 4A and 4B, restraining means in the form of clamps, herein elongated clamping pads or bars 28 are mounted on the opposed side edges 18 and 18' of structural members 18 of the rectangular contour support frame 17 and are actuated by control switch keys 29, selected by an operator person 41, on the station control device 26 to pivot over side and end edge portions 12' of a composite fabric sheet 12 positioned over the top surface 18' of the rectangular contour support frame 17 to immovably secure the composite fabric sheet 12 taunt in a horizontal suspended plane 30, as better seen in FIG. 5. As shown in FIG. 5, the clamp 28 is pivotal by suitable linkages 31 to effect a clamping motion from a disengaged position at 28' where the clamp extends upright, to a clamping position as shown in solid line wherein the side edge portion 12' of the composite fabric sheet 12 is clamped. When the clamping bar is at the upright position it acts as a guide wall to facilitate the positioning of the composite fabric sheet over the rectangular contour support frame 17 of the transport platform 13. It is important that the composite fabric sheet 12 does not move and lay taunt in the horizontal suspended plane 30 when in position in the computer control stitching and laser cutting machine 11 to produce accurate stitching.

The guide rails 14, as better shown in FIG. 4A are of u-shape cross-section with inward restraining flanges 34 wherein it forms an open captive channel 33 between opposed horizontally extending flange walls 34 whereby to retain captive therein support wheels 35 secured to the end edges 18 and 18' of the transport platform 13. These guide rails are disposed in a common horizontal plane with the guide rails of the opposed transport platform of the opposed machine 10' and across the computer controlled stitching and die-cutting machine 11.

As shown in FIG. 2, a fabric sheet length measuring and slitting machine 40 is mounted at a loading end of each of the transport platforms 13 and 13' and the composite sheet 12 is drawn there trough automatically when the machine is actuated by the operator person 41. It automatically feeds the sheet 12 from a supply roll 42 and simultaneously measures the length of the sheet passing through the feeder device 43. Once the proper length having been measured it actuates a slitter device 44 (such as a CO2 laser to prevent fraying and the application of pressure on the sheet 12) to transversely cut the composite sheet 12 to the proper length for close fit over the top flat surface of the transport platform 13. With the clamping bars in their upright vertical positions the cut sheet is easily and perfectly positioned on the flat top surface of the transport platform with the sheet bottom surface flush onto the flat top surface. It is also possible to feed individual fabric sheets as well as a core material sheet from individual supply rolls at the input end of the machines 10 and 10' to form the composite fabric sheet immediately before loading onto the machines 10 and 10'.

Figure 6:
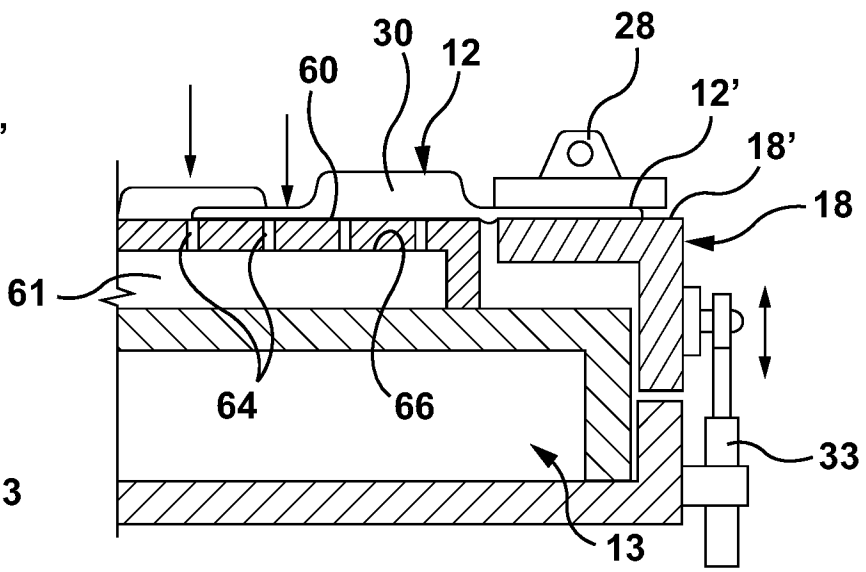
FIG. 6 is a side view, similar to FIG. 5A, showing the composite fabric sheet, with the stitched patterns having been formed therein, lowered on a perforated top wall of a suction box.

With reference now to FIGS. 5 and 6, the transport platforms 13 and 12' have a suction box 31 disposed between the structural members 18 of the rectangular contour support frame 17 and spaced below the horizontal suspended plane 30 of the composite fabric sheet 1'2. The gap 32 permits the stitching needles 59' of the stitching machine to effect their programmed stitching patterns. Once that is completed, the support frame 17 is lowered by pistons 33 connected thereto, to position the composite fabric sheet 12 with the stitched patterns onto the flat perforated top surface 60 of the suction box 31.

As shown in FIG. 6, the composite fabric sheet as been lowered on the perforated flat top surface 60 of the suction box 61 positioned thereunder. A vacuum pump 62 (see FIG. 2) is connected to the vacuum chamber 61 by an elongated flexible hose 63 supported to permit the displacement of the transport platform. The vacuum pump 62 creates a vacuum in the vacuum chamber 61 to draw air through the perforations 64 in the top wall 65 to immovably retain the fabric sheet 12 on the flat top fabric support surface 66. Although not shown, and instead of the transport platform being a vacuum platform, it is contemplated that the computer controlled stitching and laser cutting machine 11 may be provided with a suction box sixed to receive a displaceable rectangular contour frame which can be positioned spaced over the suction box and displaceable to position the composite fabric sheet thereon. By holding the bottom sheet 53 (see FIG. 8A) of the composite fabric sheet 12 firmly on the top surface 17 of the suction box, the laser slitting depth can be calculated to slit above or through the bottom sheet to form seam allowance flaps.

Figure 7:
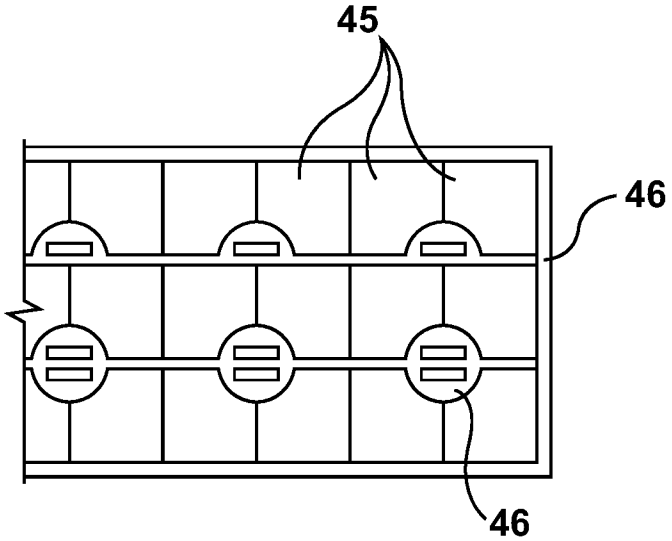
FIG. 7 is a fragmented top view of the transport platform showing the composite fabric sheet with pattern pieces having been formed therein by the stitching and laser cutting machine.

As shown more clearly in FIG. 1, the entire process and machines 10 and 10' require only one or two operator person 41 and 41' to load composite fabric sheets of their respective transport platforms 13 and 13', feed then in alternating sequence into the computer controlled stitching and laser cutting machine 11, shut off the vacuum from the suction box and unload the transport platforms and separate the formed pattern pieces 45 from the sheet trimmings 46, as shown in FIG. 7. The formed pattern pieces 45 are placed on a conveyor 47 for transport to a packaging location or to a production location. The trimmings 46, which are reduced to a minimum by the patterns inputted into the controller 27, are placed on a different conveyor 48 to transport them to a different location for disposal or recycling. A single operator person 41 can operate both machines 10 and 10' by moving from side to side unloading and loading one of the transport platforms while the pattern pieces are being formed and cut in the computer controlled and laser cutting machine 11.

Figure 8A:
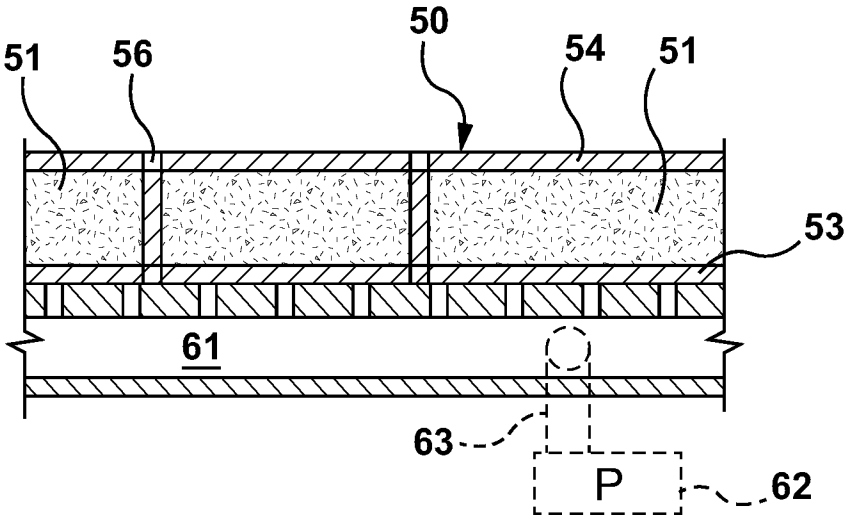
FIGS. 8A and 8B are fragmented side section views illustrating various steps performed by the stitching and laser cutting machine to form the pattern fabric pieces.
Figure 8B:
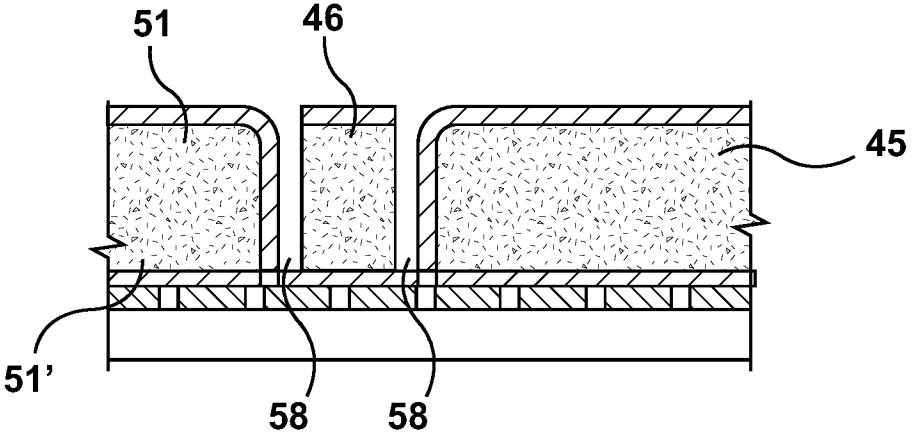

With reference now to FIGS. 8A and 8B, there is shown an embodiment of the composite fabric which is herein constituted by a thermally insulating fabric 50 formed by an insulating material core 51 held captive between a pair of scrim sheets, herein a bottom sheet 53 and a top sheet 54. As shown in FIG. 8A, a laser beam 56, from an appropriate type laser device 57 (see FIG. 2 cuts through the top sheet 54 and the core 51 and not through the bottom sheet 53, in certain areas of the programmed patterns, wherein to form seam allowance flaps. Such is described in my above mentioned co-pending patent application. As shown in FIG. 8B, the pattern pieces 45 are delineated by stitch lines 58 formed by the high speed stitching machine 59 of FIG. 3. It is pointed out that these computer controlled stitching and laser cutting machines 11 have several of these stitching and laser cutting devices all programmed to perform a function of a common pattern or different patterns at the same time. Also, the stitching devices can perform embroidery designs in the pattern pieces as well as the delineation of the pattern pieces 45.

The method of operation of the machine and devices illustrated in FIGS. 1 and 2 can be summarized briefly as follows. An operator person 41 positions and secures a composite fabric sheet 12, pre-measured and pre-cut, onto the rectangular contour frame 17 of the transport platform 13 of the loading and unloading machine 10. It is pointed out that the operator person can also effect the precutting of the fabric sheet but such would not be as fast and accurate as the use of the slitting and measuring machine 40. The clamps 28 are actuated by the operator person from a control device 26 selecting proper switch keys 29. The operator person then actuates the drive mechanism 19 to transfer the transport platform 13 into the computer controlled stitching and laser cutting machine 11 wherein the position of the transport platform is detected whereby the machine 11 starts the production of stitching and die cutting the programmed pattern pieces. Once the machine has completed its stitching task, the rectangular contour frame 17 is downwardly displaced to position the taunt composite fabric sheet 12 with its stitched patterns over the top surface 60 of the suction box 31 and the suction pump 62 is automatically switched on the immobilize the composite material sheet on the suction box. The laser then effects its programmed function of cutting patterns in the composite fabric sheet and the transport platform, with the vacuum still applied, is automatically returned to its initial position. The fabric pieces are retained in position during cutting and transport by the suction box. The operator person switches the vacuum pump off and the pattern pieces and trailings are now disengaged from the pulling force of the vacuum and free to be removed. At that time the other operator person 41 on the other side of the machine 11 can transfer its transport platform with a composite sheet engaged thereon into the machine 11. Meanwhile, the unloaded transport platform is unloaded of its cut pattern sheets and sheet trimmings and a further composite sheet is clampingly engaged waiting to be transferred again into the computer controlled stitching and laser die cutting machine 11.

It is within the ambit of the present invention to cover any obvious modifications of the embodiment of the present invention described herein, provided such modifications fall within the scope of the appended claims.

The invention claimed is:

1. A composite fabric sheet loading and pattern pieces unloading machine for positioning the composite fabric sheet in a computer controlled stitching and laser die cutting machine, said loading and unloading machine comprising at least one transport platform displaceably mounted on a support frame, said transport platform having a rectangular contour support frame for supporting said composite fabric sheet taunt in a horizontal suspended plane, restraining means for restraining said fabric sheet over said rectangular contour support frame, displacement means for displacing said transport platform from a fabric sheet loading and pattern pieces unloading position to a fabric sheet pattern forming position in said stitching and laser cutting machine and back to said fabric sheet loading and pattern pieces unloading position for discharging formed fabric pattern pieces, and a suction box disposed between structural members of said rectangular contour support frame and spaced below said horizontal suspended plane, said suction box having a perforated top wall, a vacuum pump in communication with said suction box, said vacuum pump creating a vacuum in said suction box to draw air through said perforated top wall to immovably retain said composite fabric sheet on a flat top fabric support surface of the structural members when lowered thereon.

2. The composite fabric sheet loading and pattern pieces unloading machine as claimed in claim 1 wherein the structural members define opposed parallel side edges and end edges, said restraining means are clamping restraining means secured along at least two of said opposed parallel side edges of said structural members for holding said composite fabric sheet taunt between said at least two of said side edge and end edge.

3. The composite fabric sheet loading and pattern pieces unloading machine as claimed in claim 2 wherein said clamping restraining means is comprised of clamps secured along a respective one of said opposed parallel side and end edges, said clamps being displaceable from an engaging position, wherein said clamps are displaced over side edge portions of said composite fabric sheet disposed on the flat top fabric support surface of said structural members, to a retracted position wherein at least some of said clamps extend upright to form a guide for accurate positioning of said composite fabric sheet on said flat top fabric surface of said structural members.

4. The composite fabric sheet loading and pattern pieces unloading machine as claimed in claim 3 wherein said clamps are elongated clamping bars having an elongated flat clamping wall which when in an upright retracted position forms a guide wall about at least some of said side and end edge structural members of said rectangular contour support frame.

5. The composite fabric sheet loading and pattern pieces unloading machine as claimed in claim 1 wherein said rectangular contour support frame is a horizontally displaceable frame displaceable from a stitching position where said composite fabric sheet is held at said horizontal suspended plane to a laser cutting position where said composite fabric sheet is disposed on said perforated top wall of said suction box whereby to hold said composite sheet and cut pattern pieces immovable on said perforated top wall.

6. The composite fabric sheet loading and pattern pieces unloading machine as claimed in claim 1 wherein said displacement means comprises a guide mechanism for restraining displacement of said transport platform from said fabric sheet loading and pattern pieces unloading position to said fabric sheet pattern forming position, said guide mechanism being a planar guide mechanism to effect said displacement in a single plane.

7. The composite fabric sheet loading and pattern pieces unloading machine as claimed in claim 6 wherein said guide mechanism is comprised by a pair of opposed guide rails, each rail of said pair of opposed guide rails extending parallel to one another and adapted to receive support wheels secured to said opposed parallel end edges of said rectangular platform for captive displacement therewith.

8. The composite fabric sheet loading and pattern pieces unloading machine as claimed in claim 6 wherein said displacement means further includes a motorized drive mechanism comprised of one or more drive belts connected to said rectangular contour support frame of said transport platform and a support frame of said stitching and laser cutting machine, said drive belt being trained about a drive sprocket and an idle sprocket, a motor for driving said drive sprocket, said transport platform having a belt connector secured there under and attached to said drive belt.

9. The composite fabric sheet loading and pattern pieces unloading machine as claimed in claim 1, further comprising a fabric length measuring and slitting machine for measuring and cutting a predetermined length of said composite fabric sheet from a supply roll of said composite fabric sheet to from a rectangular composite fabric sheet for close fit on a flat top fabric support surface of the transport platform.

10. The composite fabric sheet loading and pattern pieces unloading machine as claimed in claim 1, further comprising the stitching and laser cutting machine, wherein there are two of said transport platforms disposed one on a respective one of opposed sides of said stitching and laser cutting machine.

11. The composite fabric sheet loading and pattern pieces unloading machine as claimed in claim 10 further comprising a pair of opposed guide rails mounted between said support frame of said two transport platforms and extending through said stitching and laser die cutting machine in a common horizontal plane for support displacement of said two transport platforms in alternating continuous sequence in and out of said stitching and laser cutting machine.

12. The composite fabric sheet loading and pattern pieces unloading machine as claimed in claim 11 wherein said two of said transport platforms are displaced in alternative sequence on a respective one of said guide rails by a synchronised drive mechanism wherein while one of said transport platforms is in said stitching and laser cutting machine the other of said transport platform is at said fabric sheet loading and pattern pieces unloading position for the removal of formed pattern pieces and fabric trimmings from said a perforated top wall of a suction box where a vacuum pump has been shut off for the removal of fabric pieces, and then further engaging another composite fabric sheet on said rectangular contour support frame.

13. The composite fabric sheet loading and pattern pieces unloading machine as claimed in claim 1 wherein said composite fabric sheet is one of an outer fabric sheet and a liner sheet, and an outer fabric sheet and a liner sheet with an insulating material core therebetween.

14. A method of positioning a composite fabric sheet in a computer controlled stitching and laser cutting machine to form composite fabric pattern pieces, said method comprising the steps of:

(i) positioning a rectangular composite fabric sheet on a rectangular contour support frame of at least one transport platform at a fabric sheet loading and pattern pieces unloading location;

(ii) retaining said composite fabric sheet in a horizontal suspended plane by restraining means onto said rectangular contour support frame;

(iii) guidingly displacing said transport platform at a precise location into said stitching and laser cutting machine;

(iv) stitching contour patterns in said composite fabric sheet held in said horizontal suspended plane;

(v) displacing said fabric sheet onto a flat top fabric support surface spaced below said horizontal suspended plane;

(vi) laser cutting said fabric pattern pieces about said stitched contour patterns to form individual pattern pieces;

(vii) guidingly displacing said transport platform, after said individual pattern pieces are formed, back to said fabric sheet loading and pattern pieces unloading position;

(viii) removing said individual pattern pieces and fabric trimmings from said transport platform, and (ix) positioning another composite fabric sheet on said rectangular contour support.

15. The method of claim 14 wherein said step (ii) comprises damping said composite fabric sheet along opposed edge portions thereof onto said rectangular contour support frame to retain said composite fabric sheet taunt in said horizontal suspended plane.

16. The method of claim 14 wherein said flat top fabric support surface is that of a perforated top wall of a suction box secured to said transport platform, a vacuum chamber under said perforated top wall and a vacuum pump in communication with said vacuum chamber, said step (v) comprising immovably retaining said composite fabric sheet by the application of a vacuum in said vacuum chamber under said perforated top wall of said suction box.

17. The method of claim 14 wherein there are two of said transport platforms disposed one on a respective one of opposed sides of said computer controlled stitching and laser cutting machine, and wherein when one of said transport platforms is undergoing said step (iii) the other of said transport platforms is undergoing said steps (viii) and (ix).

18. The method of claim 14 wherein said step (viii) comprises removing and separating said formed pattern pieces from said fabric trimmings.

* * * * *